US006754137B1

(12) United States Patent
Bourquin et al.

(10) Patent No.: US 6,754,137 B1
(45) Date of Patent: Jun. 22, 2004

(54) WATCH PROVIDING BAROMETER OR ALTIMETER READING, AND METHOD FOR MAKING SAME

(75) Inventors: Michael Bourquin, St-Prex (CH); Christophe Germiquet, Prêles (CH); Jean-Jacques Born, Morges (CH)

(73) Assignee: Asulab S.A., Marin (CH)

( * ) Notice: Subject to any disclaimer, the term of this patent is extended or adjusted under 35 U.S.C. 154(b) by 0 days.

(21) Appl. No.: 09/869,019

(22) PCT Filed: Dec. 22, 1999

(86) PCT No.: PCT/EP99/10317

§ 371 (c)(1),
(2), (4) Date: Jun. 22, 2001

(87) PCT Pub. No.: WO00/39644

PCT Pub. Date: Jul. 6, 2000

(30) Foreign Application Priority Data

Dec. 23, 1998 (EP) ..... 98124577

(51) Int. Cl.[7] ..... G04B 47/06
(52) U.S. Cl. ..... 368/11; 368/10
(58) Field of Search ..... 368/10, 11, 74, 368/72

(56) References Cited

U.S. PATENT DOCUMENTS 3,839,626 A * 10/1974 Klem et al. ..... 73/384
3,880,009 A 4/1975 Johnston
4,015,208 A 3/1977 Hammer et al.
4,106,343 A 8/1978 Cook
4,236,239 A * 11/1980 Imgruth et al. ..... 368/72
4,493,559 A * 1/1985 Ishida et al. ..... 368/74
4,783,772 A * 11/1988 Umemoto et al. ..... 368/11
4,835,716 A 5/1989 Tamaki et al.
4,876,677 A * 10/1989 Moriya ..... 368/87
5,224,059 A * 6/1993 Nitta et al. ..... 368/11
5,317,921 A 6/1994 Kremidas
5,357,488 A * 10/1994 Udo et al. ..... 368/11
5,500,509 A * 3/1996 Vogt ..... 219/501
5,500,835 A * 3/1996 Born ..... 368/11
5,592,442 A * 1/1997 Nishikawa et al. ..... 368/11
5,724,317 A * 3/1998 Kubota et al. ..... 368/11
6,278,659 B1 * 8/2001 Yokouchi ..... 368/11
6,519,548 B1 * 2/2003 Kuroda et al. ..... 368/11

FOREIGN PATENT DOCUMENTS

EP 345 929 A1 4/1989
EP 670 532 A1 2/1995
EP 677 798 A2 4/1995
JP 404296690 A * 10/1992 ..... 368/10
JP 404339294 A * 11/1992 ..... 368/10

* cited by examiner

*Primary Examiner*—David Martin
*Assistant Examiner*—Jeanne-Marguerite Goodwin
(74) *Attorney, Agent, or Firm*—Sughrue Mion, PLLC

(57) ABSTRACT

The wristwatch includes in its case a resistive piezo-electric pressure and temperature sensor (26) exposed to a pressure chamber (42) communicating with the outside environment, for measuring ambient pressure. In order to provide individual calibration as a function of temperature followed by a permanent correction of the sensor pressure signals, the latter is fixed to the lower surface of a printed circuit board (30) bearing the electronic circuits (35) processing the sensor signals. The calibration parameters are stored in a non-volatile memory (36) of said circuits. A rigid and sealed separating wall (43) forms an internal bottom separating the pressure chamber (42) from the watch sealed part.

14 Claims, 3 Drawing Sheets

WATCH PROVIDING BAROMETER OR ALTIMETER READING, AND METHOD FOR MAKING SAME

The present invention concerns an electronic watch providing barometer or altimeter reading based on ambient pressure, including:

a case the interior of which is divided by separating means into a sealed part and a pressure chamber which communicates with the exterior of the case so as to receive the ambient pressure, an electric power source, a pressure sensor having one side exposed to the pressure prevailing in the pressure chamber, display means for providing time indication and said barometer or altimeter reading, and a printed circuit board disposed in the sealed part of the case and provided with timekeeping circuits and electronic circuits arranged to receive and process an output signal from the pressure sensor and to control the barometer or altimeter reading display means.

The invention also concerns a method for manufacturing such a watch.

Electronic watches of this type are known, in particular from U.S. Pat. No. 4,835,716 or from European Patent No. 640 896 which provides the analogue display of the atmospheric pressure, the tendency of such pressure and the altitude by means of hands in connection with the watch dial.

In this type of barometer and/or altimeter watch, the implantation of the pressure sensor poses problems as regards the space requirement, the watch tightness, electric connections and the internal deformations due to the pressure differences between the sealed part and the pressure chamber in which ambient pressure prevails, i.e. atmospheric pressure, to which hydrostatic pressure is added if the watch is immersed in water.

The case of the first electronic barometer and/or altimeter watches included a lateral appendix specially designed to contain the pressure sensor and having orifices communicating with the outside environment. See for example U.S. Pat. No. 4,783,772 and European Patent No. 345 929. This solution had the advantage of keeping the sealing system of conventional watch cases, but this appendix was unattractive and sometimes inconvenient. This thus lead to the pressure sensor being implanted inside a watch case of ordinary shape, which requires a pressure chamber in case.

This results in additional difficulties to assure the sealing and resistance to pressure prevailing within the case.

For example in the watch disclosed in European Patent No. 640 896, the pressure sensor is housed in the case in proximity to the middle part, under a plate of the clockwork movement against which it is held. A small pressure chamber is arranged between the top of the sensor and the plate and communicates with the exterior via a channel which passes through the plate and the middle part and opens out under a rotating bezel. A cover arranged between the back cover of the case and the sensor carries electric connections connecting the latter to an integrated circuit located beside the sensor and processing the signal to provide barometer and/or altimeter readings. Additional electric connections are necessary to connect this integrated circuit to the other electric circuits of the watch, in particular to those which control the display.

This known construction takes a considerable amount of space as regards height and requires special arrangements to assure sealing around the pressure chamber and around the channel connecting the latter to the outside.

Further, there is a problem of variation in the sensor output signal as a function of temperature. This variation is different from one sensor of the same type to the next. For a variation of 10° C., the altimeter readings provided with piezo-electric sensors currently used, which are relatively inexpensive, may vary by up to approximately. 100 m in altitude.

The Applicant has imagined calibrating each sensor as a function of temperature variations, calculating the signal calibrating parameters and storing them in the electronic circuits associated with the sensor, but such a process would be excessively expensive in the industrial manufacture of a watch according to European Patent No. 640 896 because it could only be applied once the sensor and the associated electronic circuits are assembled, i.e. after assembly thereof in the case.

In European Patent No. 670 532, an internal bottom is provided separating the interior of the watch case into a sealed part, which contains the watch movement, and a pressure chamber which is located between the internal bottom and an outer bottom which is pierced with several holes. The internal bottom carries a pressure sensor which is electrically connected to the electronic movement control by a flexible contact tongue allowing any bending of the internal bottom due to pressure to be absorbed. However, this construction has a relatively large thickness and does not resolve the aforementioned calibration problem.

The object of the present invention is to avoid the aforementioned drawbacks and it concerns a watch, in particular a wristwatch, allowing individual calibration of the readings provided by an inexpensive pressure sensor, owing to a suitable construction and an economically acceptable manufacturing method.

An additional object of the invention consists in arranging the watch so as to guarantee proper sealing and to avoid problems due to deformations resulting from variations in ambient pressure in the pressure chamber.

According to a first aspect of the invention, there is provided an electronic watch of the type defined hereinbefore, characterised in that the pressure sensor is secured to the printed circuit board, to which it is directly connected by electric connections.

These features allow the pressure sensor to be associated with the electronic circuits intended to process its output signal, at an early stage of manufacture. Thus, temperature measuring means may be installed on the printed circuit board and the electronic circuits may include a non volatile memory wherein individual calibrating parameters of the pressure sensor can be stored, and these parameters can be determined and stored in the memory before the instrument is assembled, as will be explained hereinafter.

However, it should be noted that the invention may also be implemented in an instrument which has no temperature measuring means, thus, also without using a memory for individual pressure sensor calibrating parameters, either because inferior pressure measuring precision is accepted, or because a pressure sensor which is temperature compensated or which has a low temperature related drift becomes available at an acceptable price.

Preferably, the separating means include a separating wall connected to the case in a sealed manner along its periphery and having an opening in which said sensor is placed.

This allows the case interior to be conveniently divided into a sealed part and a pressure chamber which may have any shape and size. This wall bears the effect of the external pressure in the pressure chamber and thus protects the plate carrying the display members and, if necessary, the clockwork movement in the sealed part. The separating wall may easily be connected to the case in a sealed manner along its periphery, like a double bottom, and the pressure chamber extending between this double bottom and the back cover of the case may advantageously contain an electro-acoustic transducer arranged to transmit sounds in this chamber which communicates with the outside.

The sensor used is preferably a pressure and temperature sensor of the piezo-resistive type including resistors connected in a Wheatstone bridge in which the bridge resistance varies only as a function of temperature, while variations in pressure create an unbalance in the bridge.

Another aspect of the invention concerns a method for manufacturing a watch as defined above, wherein said electronic circuits include a non volatile memory intended for storing the individual pressure sensor calibrating parameters, the method including the successive steps of:

a) manufacturing the printed circuit board and mounting at least the pressure sensor and said electronic circuits on this board to form a sub-assembly;

b) calibrating said sub-assembly in different temperature and pressure conditions and determining sensor calibrating parameters as a function of such conditions;

c) storing the calibrating parameters in the non volatile memory of the electronic circuits;

d) if necessary, completing the sub-assembly with other components which have to be carried by the printed circuit board; and e) mounting said sub-assembly and the other watch components in the case.

Other features and advantages of the invention will appear in the following description of a preferred embodiment, given by way of non limiting example with reference to the annexed drawings, in which.

Figure 1:
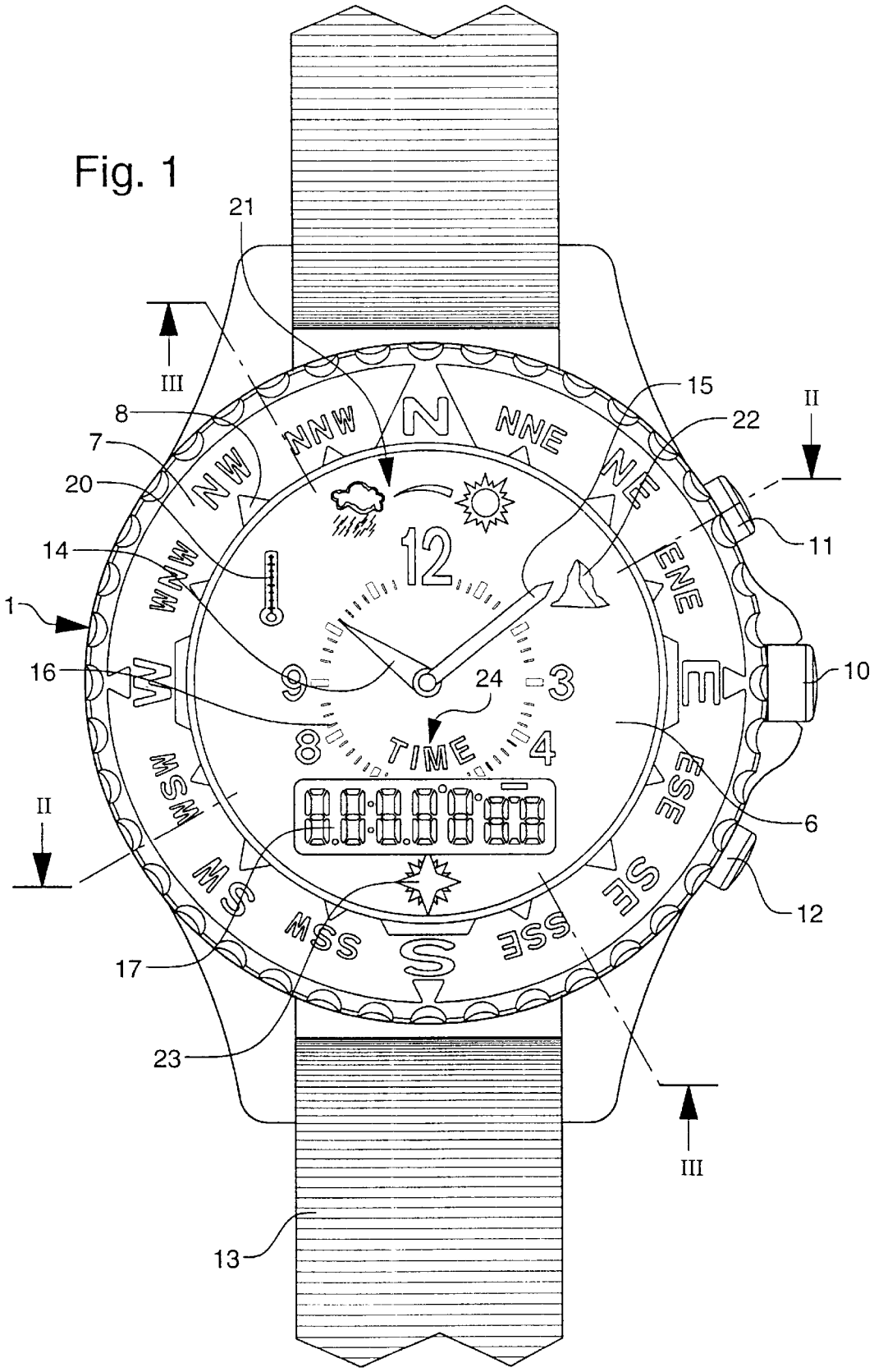
FIG. 1 is a top view of a wristwatch made according to the present invention.
Figure 2:
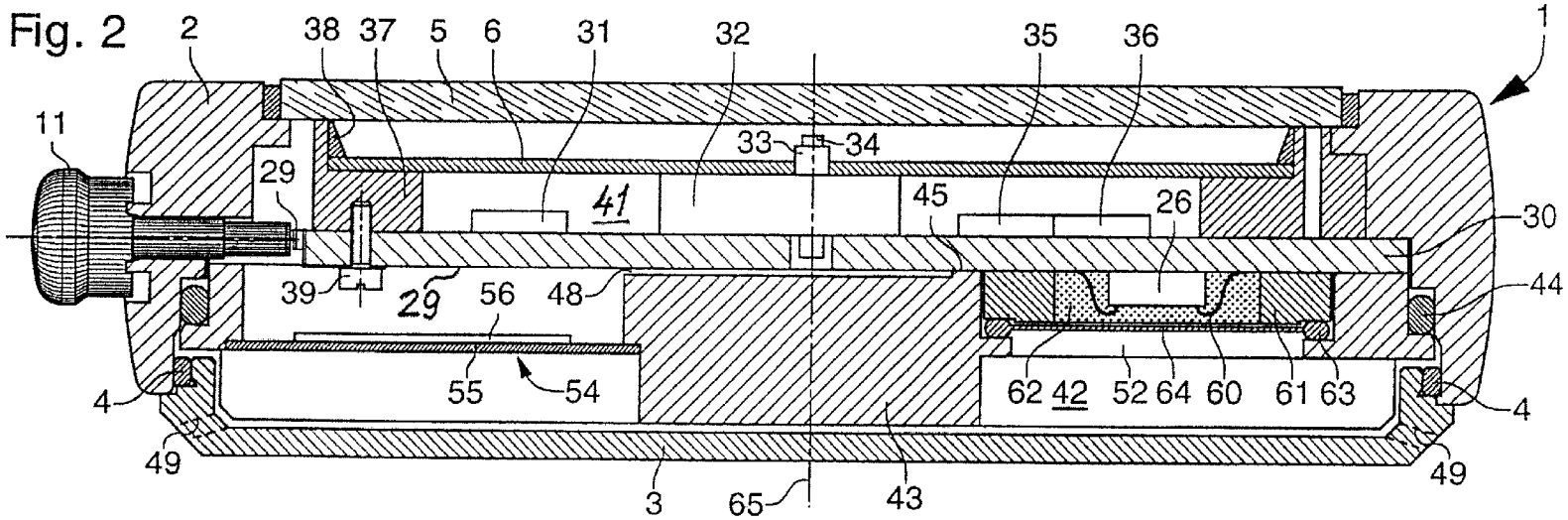
FIG. 2 is a schematic cross-section of the watch of FIG. 1 along the line II—II, without the rotating bezel.
Figure 3:
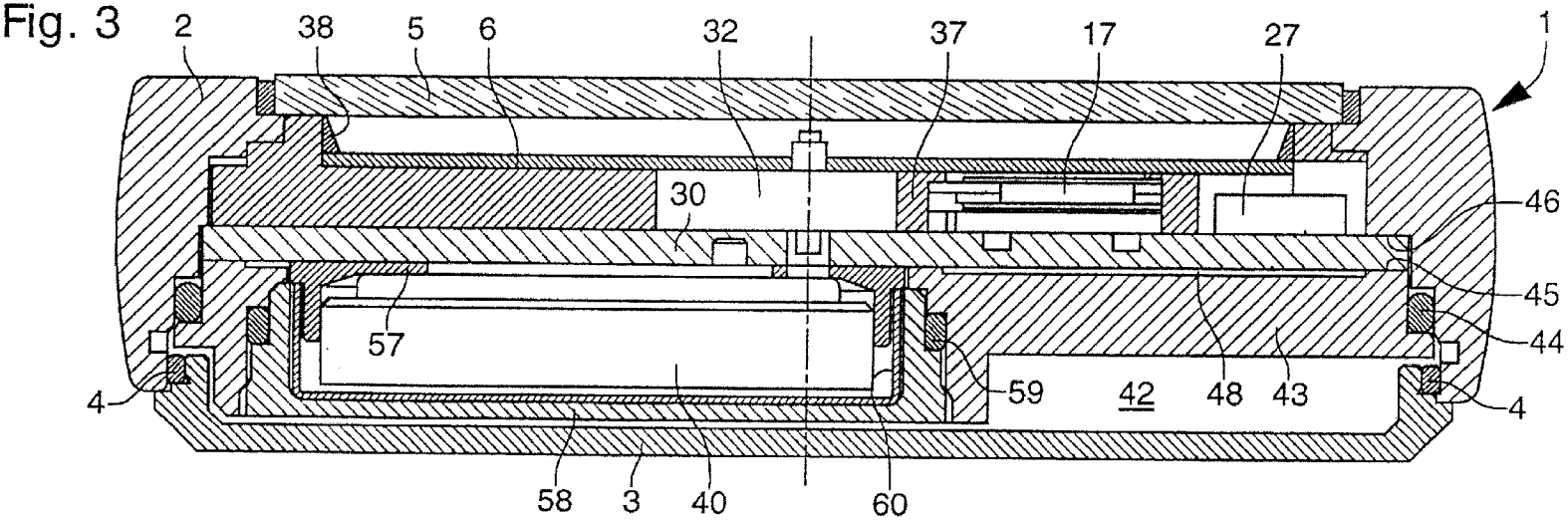
FIG. 3 is a schematic cross-section of the watch of FIG. 1 along the line III—III, without the rotating bezel.

The watch shown in FIGS. 1 to 3 includes a case 1 including a middle part 2, a removable back cover 3 mounted on the middle part using a compressible sealing gasket 4, and a crystal 5 secured to the middle part and covering a dial 6. The middle part 2 carries a rotating bezel 7 bearing azimuth markings 8. The bezel has been omitted from FIGS. 2 and 3 in order to simplify the drawings. In a conventional manner, external control members are provided in the form of three lateral push-buttons 10, 11 and 12. Case 1 is attached to a wristband 13, For the analogue time display, there is an hour hand 14 and a minute hand 15 which co-operate with a conventional time scale 16 on dial 6. These hands are also used to display other readings, as will be described hereinafter. Further, a digital display is formed by a liquid crystal cell (LCD) 17 preferably placed under a transparent window of dial 6 and intended to display measured times obtained in a conventional manner by manipulating push-buttons 11 and 12, as well as other values which will be mentioned hereinafter.

The watch described here also constitutes an electronic instrument performing various measuring or indicating functions in addition to time measurements or indications. These additional functions, more precisely the corresponding operating modes of the watch, are represented on dial 6 by symbols 20 to 23, while another symbol 24 (TIME) represents the conventional time display mode of the watch. In this example, the user switches on the desired mode by means of capacitive control members including transparent electrodes (not shown) fixed underneath crystal 5 above the corresponding symbols 20 to 24. Such control members are well known and are described in particular in Patent publication Nos. JP 49-13168A, CH 607 872 and EP 674 247. However, different control members may be provided within the scope of the present invention.

Symbol 20 in the shape of a thermometer represents an ambient temperature display mode, which is indicated digitally by LCD cell 17. This temperature is measured using a pressure and temperature sensor 26 which will be described hereinafter. Symbol 21 including a cloud and a sun corresponds to a barometer tendency indication mode, indicated by means of hands 14 and 15 which are superposed and brought close to the cloud or the sun. This tendency is calculated from the pressure readings provided by sensor 26. Symbol 22 in the shape of a mountain corresponds to an altitude display mode, which is indicated digitally on LCD cell 17. This altitude is calculated from barometer readings obtained using sensor 26. Symbol 23 in the form of a wind rose corresponds to a compass function, i.e. the indication of north by means of hands 14 and 15 set in aligned positions and allowing an azimuth to be read on bezel 7. This direction is determined using a magnetic field direction sensor 27, incorporated in the instrument for example as is described in European Patent publication No. 713 162. Given that the present invention essentially relates to the means used to provide barometer or altitude readings, the other functions of the watch will not be described in detail here. It will also be noted that such a watch may also include further functions, for example a chronograph, an alarm at a predetermined time or at a predetermined altitude, an end of life indication for a battery, radio-controlled time adjustment, reception of radio calls (paging), etc.

As is seen particular in FIGS. 2 to 5, the watch contains a printed circuit board 30 which also acts as a plate for the electronic watch movement. For this purpose, board 30 has a relatively rigid and thick substrate, for example of approximately 1.0 mm. On the upper surface of the printed circuit board 30 are mounted in particular:

time-keeping circuits schematically represented by the reference 31 and including in particular a quartz resonator and an integrated circuit, a stepping motor 32 with two rotors respectively driving two concentric output shafts 33 and 34 which carry hands 14 and 15, electronic circuits 35 provided with a non volatile memory 36 (for example of the EEPROM type) and intended to process the output signals from sensor 26, magnetic sensor 27, other electronic circuits which are not shown, intended to process the signals from magnetic sensor 27, and a spacer 37 secured to dial 6 and carrying a flange 38 and LCD cell 17.

Screws 39 secure board 30 to spacer 37. Printed circuits on the upper surface of board 30 assure the electric connections between elements 31, 32, 35 and 36 and connections with the control members described hereinbefore and with contactors 29 disposed on the periphery of the board and actuated by push-buttons 10 and 12.

The lower surface 29 of board 30 also carries printed circuits which are connected to those of the upper surface, to sensor 26 and to power supply connections connecting these circuits to a battery 40 housed in the bottom part of case 1.

The interior of the watch case is divided into a sealed part 41, which contains in particular printed circuit board 30 and all the elements arranged between it and crystal 5, and a pressure chamber 42, by separating means mainly comprising a rigid separating wall 43 the periphery of which is connected to middle part 2 in a sealed manner by means of an O ring sealing gasket joint 44. The upper surface of wall 43 has, along said periphery and around the region of sensor 26, a horizontal support surface 45 which abuts against board 30 and, via the latter, against a suitable shoulder 46 of middle part 2. Board 30 is secured to wall 43 by screws which are not shown, screwed into thick portions 47 of the wall. Outside support surface 45, the upper surface of wall 43 is slightly recessed so as to leave a small vertical gap 48 between it and board 30. This allows wall 43 to bend under to effect of the external pressure without any risk of deforming board 30 forming the plate of the watch movement.

Since wall 43 can be relatively thick, for example, as thick as battery 40, it has to be rigid enough to bear high pressure, particularly in a diver's watch. It may be made of a synthetic material or metal. The inner structure formed by wall 43, board 30 and spacer 37 is secured in case 1 by means of conventional clamps which are not shown, which are secured to middle part 2 and abut against the lower surface of wall 43 to press said structure against shoulder 46.

The sealed part of the case interior contains air or another gas. Pressure chamber 42 contains air and communicates with the atmosphere via one or more orifices 49 arranged for example through the periphery of back cover 3, so that it is always subjected to the exterior ambient pressure.

Figure 4:
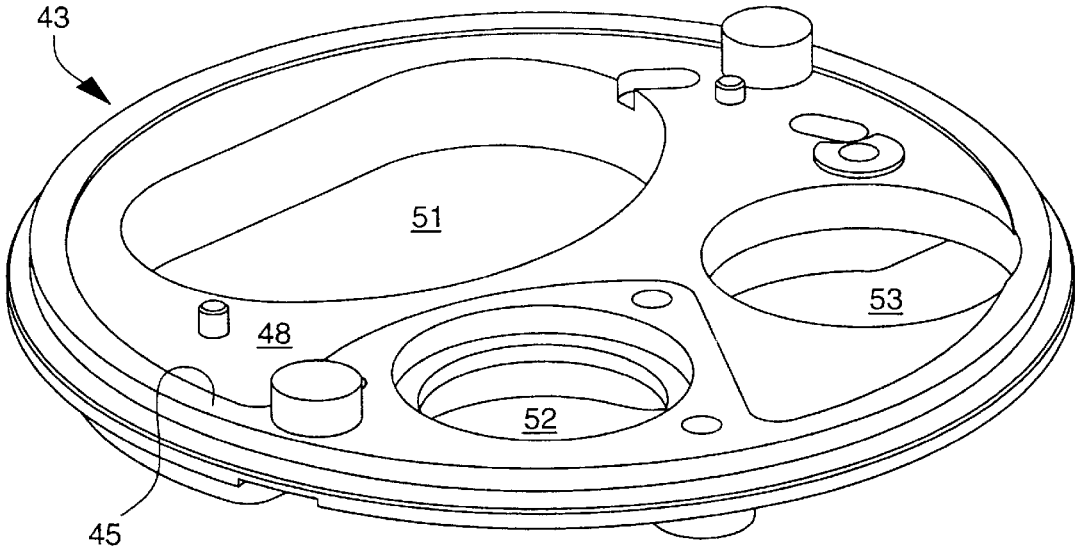
FIGS. 4 and 5 show in perspective respectively the top and bottom of a separating wall forming part of the watch of FIG. 1.
Figure 5:
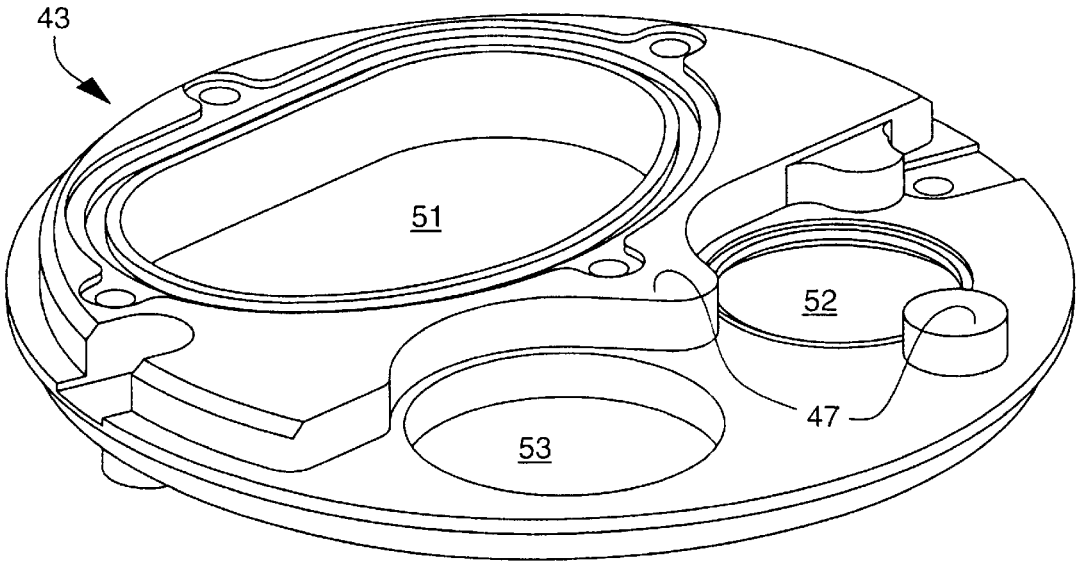

As can be seen in FIGS. 4 and 5, wall 43 includes three apertures 51, 52 and 53 occupied respectively by battery 40, pressure and temperature sensor 26 and an electro-acoustic transducer 54 intended to supply an acoustic signal to the user. This transducer includes a vibrating plate 55 glued to wall 43 and a piezoelectric ceramic element 56 secured onto plate 55 on the side of the sealed part of the watch.

Aperture 52 accommodating sensor 26 is located in proximity to the periphery of wall 43, support surface 45 of this wall being applied against board 30 all around this aperture. Since any bending of wall 30 would only have a small amplitude in this peripheral zone, there is no risk of it excessively deforming board 30 acting as the watch movement plate.

Battery 40 is inserted so as to slide in a battery support 57 of annular shape, secured to the lower surface of board 30. It is separated from pressure chamber 42 by a cap 58 engaged in a sealed manner in aperture 51 of wall 43, owing to an O ring sealing gasket 59. The cap is covered on the inside with a shielding 60 arranged to prevent any magnetic influence by the battery on magnetic sensor 27. Cap 58 may be secured to wall 43 by a bayonet type system or held by other suitable means.

Thus, it is to be noted that plate 55 and cap 58 co-operate with wall 43 to divide the interior of the case into two parts in the present example. However, these elements could be arranged in a different way and not form part of the separating means.

Pressure and temperature sensor 26 is a piezo-resistive sensor of a known type and inexpensive, made of an element of micromachined silicon including a membrane one face of which is exposed to the ambient pressure prevailing in pressure chamber 42, while the other face carries resistors connected in a Wheatstone bridge, as is provided for example in U.S. Pat. No. 4,783,772. In the present case, the resistors are arranged so that the global resistance of the bridge vary only as a function of temperature, while variations in pressure create unbalance in the bridge, resulting in variations in voltage across its two output terminals. Thus, via bonding wires 60 connecting them directly to board 30, sensor 26 supplies integrated circuit 35 with output signals representing both the pressure and temperature to which the sensor is exposed. This sensor may be for example of the type AM761 marketed by the company Intersema Sensoric in Bevaix, Switzerland.

Sensor 26 is protected by means of a ring 61 glued to board 30 and engaged in aperture 52 of wall 43, and a silicon gel 62 which also coats wires 60. This gel is electrically insulating and water resistant. An O-ring type sealing gasket 63 is compressed, preferably axially, i.e. parallel to central axis 65 of the watch, between ring 61 and an edge of the wall, and its central portion is closed in a sealed manner by a flexible membrane 64 which allows the pressure to be transmitted from chamber 42 to gel 62 and to sensor 26. It will be noted that this membrane is optional, but it has the advantage of preventing gel 62 from moving or being polluted. In a variant, a sealing gasket 63 without a membrane could be placed directly between board 30 and wall 43, in an annular recess arranged around the top edge of aperture 52.

A significant advantage of the construction described hereinbefore is that separating wall 43, with elements 55, 58, 63 and 63 closing its three apertures, constitutes a rigid and sealed inner bottom which protects all the electronic and clockwork components of the watch against pressure and external agents and allows the arrangement, between it and the real back cover 3 of the case, of a pressure chamber which covers the entire extent of back cover 3 and thus allows the latter to be secured to middle part 2 in a simple and easily dismantled way, since back cover 3 is not stressed by external pressure. As a result the replacement of battery 40 is easy and is not liable to harm the inner watch elements. Moreover, the acoustic signals transmitted by transducer 54 in pressure chamber 42 may easily propagate towards the exterior without having to pass through back cover 3 itself.

Another significant advantage, already mentioned above, lies in the fact that pressure and temperature sensor 26 is secured and electrically connected directly to printed circuit board 30 carrying electronic circuits 35 associated with this sensor. This is how it is possible to incorporate in the manufacturing process, at little expense, an individual calibrating step for the pressure signal as a function of the temperature signal provided by the same sensor (or by a distinct temperature sensor also mounted on the same printed circuit board). Since the manufacturing process provides a sub-assembly for each watch including at least one printed circuit board 30, pressure and temperature sensor 26 and the associated electronic circuits 35 arranged to receive and process the sensor output signals, prior to assembly of the watch and even before board 30 is fitted with other components such as motor 32 or the quartz resonator, one can easily place a batch of such sub-assemblies in predetermined temperature and pressure conditions in an enclosure, measure the output signals of each sensor 26 before and/or after they are processed by electronic circuits 35, determine individual signal calibrating parameters of the sensor with a view to subsequently correcting these signals by the electronic circuits, and store these calibrating parameters in non volatile memory 36 so that electronic circuits 35 can use them constantly thereafter.

Since it is time-consuming to obtain a uniform stable temperature of the parts contained in the enclosure, batch processing has the advantage of assuring high productivity, one batch being able to include several hundred sub-assemblies which are all electrically connected to a common support allowing transmission of the signals to the calibrating apparatus. The latter can thus calibrate and monitor the sub-assemblies in a successive manner at a high rate.

Thus, the calibrated sub-assemblies can be completed by the other elements having to be carried by board 30. With the construction described hereinbefore, each board 30 acting as a plate will then be secured on the one hand to spacer 37 and on the other hand to separating wall 43, the dial and the hands will be mounted, then the assembly will be able to set in place in the case from the bottom. It will also be noted that, in this assembly mode, the fact that sealing ring 63 is compressed in the axial direction facilitates assembling and guarantees good long term sealing in the zone of sensor 26. Since sealing ring 63 is gripped by the screws securing board 30 to wall 43, it is independent of the way in which these two elements are secured to the case.

Given that the pressure values calculated in the conventional way from the output signals of sensor 26 are corrected using calibrating parameters individually determined for the sensor, the watches thereby manufactured are able to provide more precise barometer and altitude readings than the watches of the aforecited prior art. The Applicant has observed that for a variation of 10° C., a dispersion range of approximately 100 m over the altitude measurements may thus be reduced to less than 5 m, for example approximately 3 m.

What is claimed is:

1. An electronic watch providing a barometer or altitude reading based on ambient pressure and including:

a case including a middle part and a back cover, the interior of said case being divided by separating means into a sealed part and a pressure chamber which communicates with the outside of said case so as to receive the ambient pressure, said separating means including a separating wall extending substantially parallel to said back cover, an electric power source, a pressure sensor having one side exposed to the pressure prevailing in said pressure chamber, display means for supplying a time indication and said barometer or altitude reading, and a printed circuit board disposed in said sealed part of said case and provided with time-keeping circuits and electronic circuits arranged to receive and process an output signal from said pressure sensor and to control said barometer or altitude reading display means, wherein said pressure sensor is mounted on a back surface of said printed circuit board, to which it is directly connected by electric connections, said separating wall having an opening in which said sensor is placed.

2. A watch according to claim 1, wherein temperature measuring means are installed on said printed circuit board and wherein said electronic circuits include a non-volatile memory in which are stored individual calibrating parameters of said pressure sensor as a function of temperature.

3. A watch according to claim 2, wherein said sensor is a pressure and temperature sensor of the piezo-resistive type including resistors connected in a Wheatstone bridge whose resistance varies only as a function of temperature, whereas pressure variations create an unbalance in said bridge.

4. A watch according to claim 1, wherein said display means include analogue display means.

5. A watch according to claim 4, wherein said printed circuit board is rigid and constitutes a plate supporting, on the opposite side to said pressure sensor, at least one electric motor for said analogue display means.

6. A watch according to claim 1, wherein said separating wall is connected to the middle part of said case in a sealed manner along its periphery.

7. A watch according to claim 6, wherein said opening is located proximate to said periphery of said separating wall.

8. A watch according to claim 7, wherein, outside a support surface encompassing said opening and abutting against said printed circuit board, a gap allowing said separating wall to bend is arranged between said separating wall and said printed circuit board.

9. A watch according to claim 6, further including sealing means disposed between said separating wall and said printed circuit board, and arranged in or around said opening.

10. A watch according to claim 9, wherein a ring surrounding said pressure sensor laterally is bonded to said printed circuit board and extends into said opening of said separating wall, said sealing means including a sealing gasket inserted between said ring and said separating wall.

11. A watch according to claim 10, wherein said sealing gasket is associated with a sealed membrane which separates said pressure sensor from said pressure chamber.

12. A watch according to claim 6, wherein said pressure chamber extends between said separating wall and said back cover.

13. A watch according to claim 12, including an electro-acoustic transducer arranged to transmit sounds into said pressure chamber.

14. An electronic watch providing a barometer or altitude reading based on ambient pressure and including:

a case including a middle part, a crystal on a front side of the watch, and a back cover on a back side of the watch, the interior of said case being divided by separating means into a sealed part and a pressure chamber which communicates with the outside of said case so as to receive the ambient pressure, an electric power source, a pressure sensor having one side exposed to the pressure prevailing in said pressure chamber, display means for supplying a time indication and said barometer or altitude reading, and a printed circuit board disposed in said sealed part of said case and provided with time-keeping circuits and electronic circuits arranged to receive and process an output signal from said pressure sensor and to control said barometer or altitude reading display means, wherein said pressure sensor is mounted on a back surface of said printed circuit board, to which it is directly connected by electric connections, said separating means including a separating wall having an opening in which said sensor is placed.

* * * * *